US011381896B2

(12) United States Patent
Dory et al.

(10) Patent No.: US 11,381,896 B2
(45) Date of Patent: Jul. 5, 2022

(54) SELF-COOLING HEADSETS

(71) Applicant: Hewlett-Packard Development Company, L.P., Spring, TX (US)

(72) Inventors: Jon R Dory, Ft. Collins, CO (US); Matthew Flach, Ft. Collins, CO (US); David H Hanes, Ft. Collins, CO (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/482,351

(22) PCT Filed: Jan. 30, 2018

(86) PCT No.: PCT/US2018/015947
§ 371 (c)(1),
(2) Date: Jul. 31, 2019

(87) PCT Pub. No.: WO2019/151988
PCT Pub. Date: Aug. 8, 2019

(65) Prior Publication Data

US 2021/0337294 A1 Oct. 28, 2021

(51) Int. Cl.
*H04R 5/033* (2006.01)
*H04R 1/10* (2006.01)

(52) U.S. Cl.
CPC ..... *H04R 1/1008* (2013.01); *H04R 1/1091* (2013.01); *H04R 2460/11* (2013.01)

(58) Field of Classification Search
CPC . H04R 1/1008; H04R 1/1091; H04R 2460/11
USPC ..... 381/373
See application file for complete search history.

(56) References Cited

U.S. PATENT DOCUMENTS

| | | | | |
|---|---|---|---|---|
| 9,743,193 | B2 | 8/2017 | López Castillo | |
| 9,942,647 | B2 | 4/2018 | Di Censo et al. | |
| 2007/0154049 | A1* | 7/2007 | Levitsky | H04R 5/04 381/371 |
| 2009/0226023 | A1 | 9/2009 | Akino | |
| 2011/0268290 | A1 | 11/2011 | Lee | |
| 2013/0142376 | A1 | 6/2013 | Lin | |
| 2015/0281827 | A1 | 10/2015 | Burgett et al. | |
| 2017/0099539 | A1 | 6/2017 | Di Censo et al. | |

FOREIGN PATENT DOCUMENTS

| | | |
|---|---|---|
| CN | 104185112 | 12/2014 |
| CN | 106686483 | 5/2017 |
| JP | 2009302800 | 12/2009 |

OTHER PUBLICATIONS

Machine Translation of Takayanagi Japanese Publication No. 10148181 (Year: 1998).*

* cited by examiner

*Primary Examiner* — Katherine A Faley
(74) *Attorney, Agent, or Firm* — Dierker & Kavanaugh PC

(57) ABSTRACT

In an example implementation, a self-cooling headset includes an ear cup to form an ear enclosure volume and a control volume. The headset also includes an intake valve to open and admit air from the ear enclosure volume into the control volume when a negative pressure is generated within the control volume, and an exhaust valve to open and release air from the control volume into the ambient environment when a positive pressure is generated within the control volume.

15 Claims, 2 Drawing Sheets

SELF-COOLING HEADSETS

BACKGROUND

Audio headsets, headphones, and earphones generally include speakers that rest over a user's ears to help isolate sound from noise in the surrounding environment. While the term "headset" is sometimes used in a general way to refer to all three of these types of head-worn audio devices, it is most often considered to indicate an ear-worn speaker or speakers combined with a microphone that allows users to interact with one another over telecom systems, intercom systems, computer systems, gaming systems, and so on. The term "headphones" can refer more specifically to a pair of ear-worn speakers without a microphone that allow a single user to listen to an audio source privately. Headsets and headphones often include ear cups that fully enclose each ear within an isolated audio environment, while earphones can fit against the outside of the ear or directly into the ear canal.

BRIEF DESCRIPTION OF THE DRAWINGS

Examples will now be described with reference to the accompanying drawings, in which.

Throughout the drawings, identical reference numbers designate similar, but not necessarily identical, elements.

DETAILED DESCRIPTION

Figure 1A:
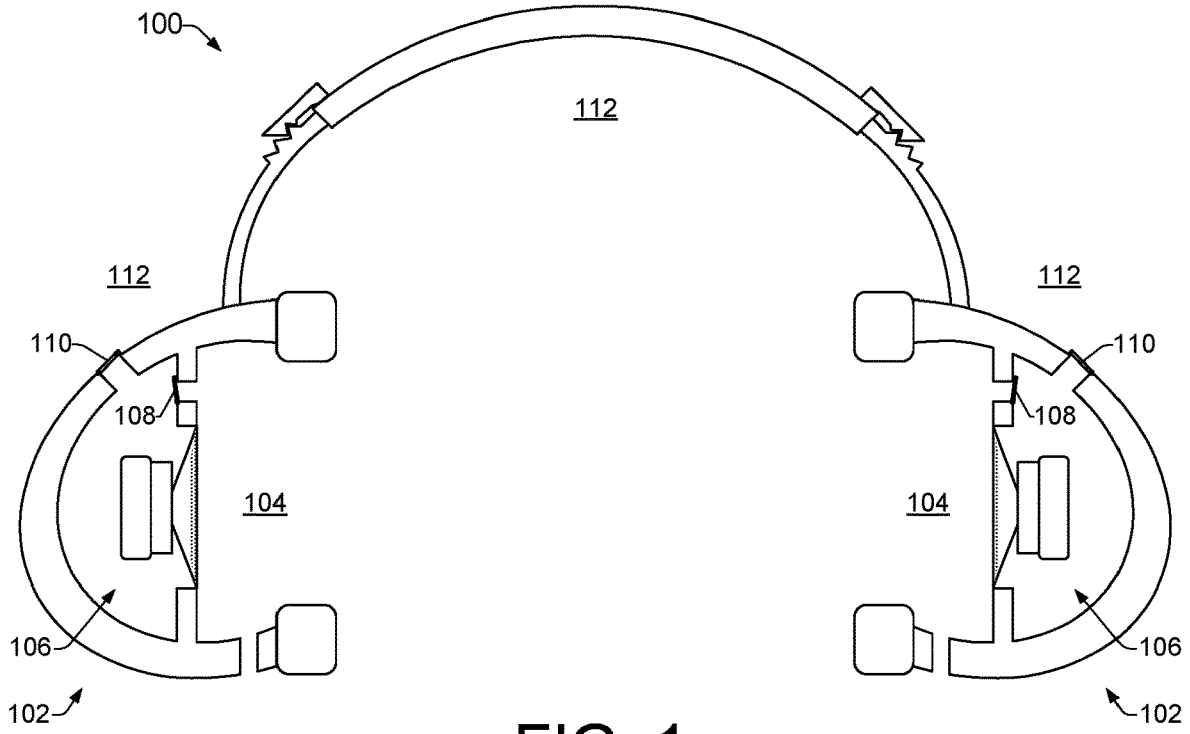
FIG. 1*a* shows an example of a self-cooling headset.

The term "headset" is sometimes used in a general way to refer to several types of head-worn audio devices including, for example, headsets, headphones, and earphones. However, it is most often considered to indicate an ear-worn speaker or speakers combined with a microphone that allows users to interact with one another over telecom systems, intercom systems, computer systems, gaming systems, and so on. As used herein, the term "headset" is intended to refer to any of a variety of different head-worn audio devices with and without a microphone. Users who wear headsets for extended periods of time can experience various types of discomfort. For example, users can experience ear pain from ill-fitting ear cups, pain in the temples from ear cups pressing against eyeglasses, general headaches from ear cups that press too tightly against the user's head, and so on. Another discomfort users often complain about is having hot ears. Gamers, for example, often use headsets for extended periods of time which can lead to increases in temperature within the ear cups and around the ears where the headset cushions press against their head. As a result, many gamers and other users often complain that their ears get hot, sweaty, itchy, and generally uncomfortable.

Headsets are generally designed so that the ear cushions press hard enough against a user's head to fully enclose each ear, and to provide an audio environment favorable for producing quality sound from an incoming audio signal while blocking out unwanted noise from the ambient environment. Maintaining user comfort while providing such an audio environment can be challenging, especially during periods of extended use. In some examples, headsets can include features that help to alleviate discomforts such as the increases in temperature associated with extended use. In some examples, headsets have been designed to include a fan or fans to actively move air into and out of the enclosed areas surrounding the user's ears. In some examples, headsets have been designed to include open vents that enable a passive circulation of air into and out of the enclosed areas surrounding the user's ears. In some examples, headsets have been designed with ear cushions comprising materials capable of conducting heat away from the user's ears. In some examples, maintaining cool air around the user's ears can depend on developing an airtight seal between the ear cup cushions and the user's skin that enables the speaker transducer to create pressure conditions that result in the circulation of air around the ears. In these types of headsets, the circulation of air can be reduced or even stopped by an imperfect or leaky seal. In general, such prior designs can help to alleviate the increases in temperature associated with the extended use of headsets. However, they can also add considerable cost to the product while providing irregular and/or varying levels of relief that may not be satisfactory to a user.

Accordingly, in some examples described herein, self-cooling headsets comprise ear cups that incorporate two adjacent chambers or volumes that work together with the motion of a speaker transducer and check valves to provide a continuous movement of fresh air around a user's ear. The two chambers or volumes in each ear cup include an ear cup volume, or ear enclosure volume that encloses and surrounds the ear, in addition to a control volume that is controlled to draw fresh air through the ear enclosure volume. Each headset ear cup includes an intake valve located between the adjacent volumes, and an exhaust valve located between the control volume and the ambient environment outside the ear cup.

A speaker transducer in each ear cup translates in a forward and reverse direction to generate sound within the ear enclosure volume as well as pressure changes within the control volume. Translation of the speaker transducer in a forward direction (i.e., toward the ear enclosure volume and away from the control volume), creates a negative pressure within the control volume that opens up the intake valve and draws air from the ear enclosure volume into the control volume. Translation of the speaker transducer in a reverse direction (i.e., away from the ear enclosure volume and toward the control volume), creates a positive pressure within the control volume that opens up the exhaust valve and pushes air out of the control volume into the ambient environment. Air pulled from the ear enclosure volume into the control volume is replaced by fresh air entering the ear enclosure volume from the ambient environment through an ambient air port. In some examples, an ambient air port can comprise varying contours of the ear cup cushions, and/or imperfections or gaps in the interface between the cushions and the user's skin that enable air leakage to occur between the cushions and the user's skin. Thus, pressure within the ear enclosure volume generally remains at an ambient pressure and circulation of fresh air within the ear enclosure volume does not depend on an airtight seal between the ear cup cushions and the user's skin. The circulation or exchange of air in the ear enclosure volume reduces the temperature within the ear enclosure volume.

In a particular example, a self-cooling headset includes an ear cup to form an ear enclosure volume and a control volume. An intake valve is to open and admit air from the enclosure volume into the control volume when a negative pressure is generated within the control volume. An exhaust valve is to open and release air from the control volume into the ambient environment when a positive pressure is generated within the control volume. A speaker transducer can translate in forward and reverse directions to generate sound within the ear enclosure volume and to generate the negative and positive pressures within the control volume.

In another example, a self-cooling headset includes an intake valve between an ear cup volume and a control volume of the headset, and an exhaust valve between the control volume and an ambient environment outside the headset. The headset includes a speaker transducer to translate in a forward direction toward the ear cup volume and a reverse direction toward the control volume. Translation in the forward direction is to generate a negative pressure within the control volume to open the intake valve and draw air into the control volume from the ear cup volume, and translation in the reverse direction is to generate a positive pressure within the control volume to open the exhaust valve and force air from the control volume into the ambient environment.

In another example, a self-cooling headset includes an ear cup volume and a control volume. An intake valve is to fluidically couple the ear cup volume with the control volume when the intake valve is opened, and an exhaust valve is to fluidically couple the control volume with an outside ambient environment when the exhaust valve is opened. A speaker transducer is to open the intake valve by translating in a forward direction, and to open the exhaust valve by translating in a reverse direction.

Figure 1B:
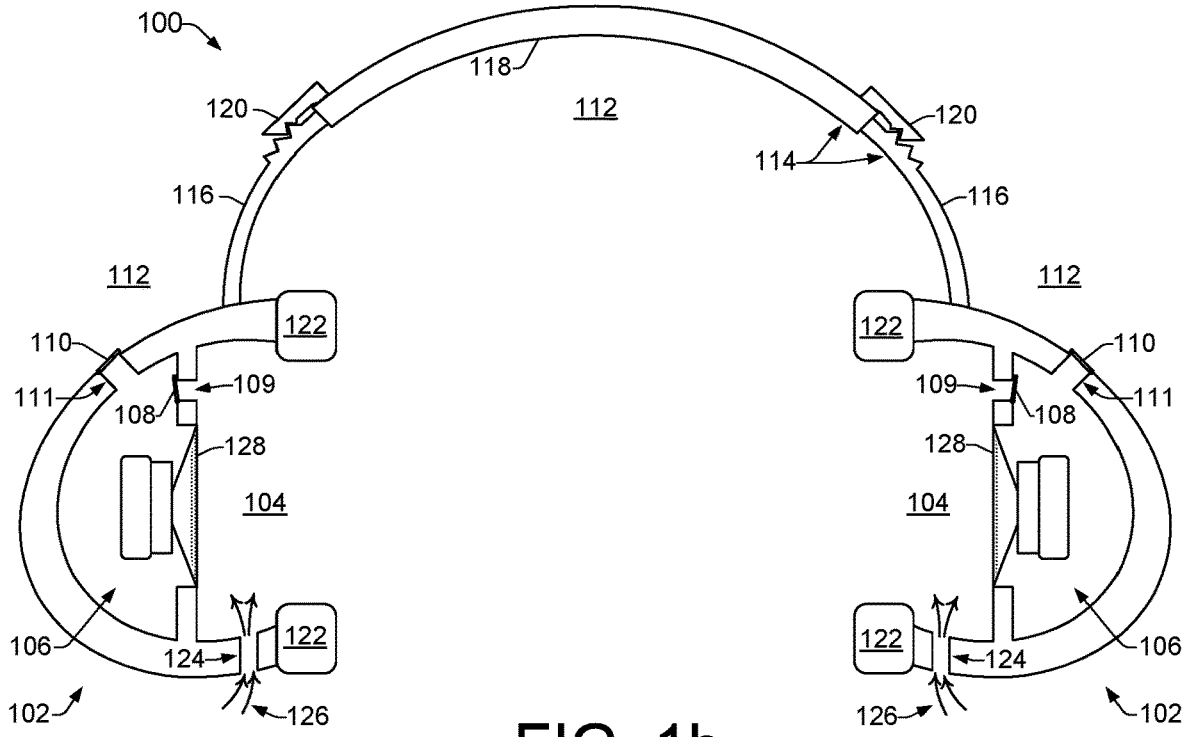
FIG. 1*b* shows an example of the self-cooling headset of FIG. 1 in greater detail.

FIG. 1*a* shows an example of a self-cooling headset 100 that comprises two ear cups 102, each ear cup having two adjacent chambers with check valves arranged to enable the passage of air through different ports in the chambers. FIG. 1*b* shows an example of the self-cooling headset 100 in greater detail. In FIG. 1 (i.e., FIG. 1*a* and FIG. 1*b*), and in other figures throughout this description, the ear cups 102 are shown in partial transparency in order to better illustrate details of different chambers and other components within the ear cups 102. Each ear cup 102 includes two adjacent chambers, or volumes. A first chamber 104 comprises an ear enclosure volume 104, and a second chamber 106 comprises a control volume 106. Each ear cup 102 comprises at least two check valves that include an intake valve 108 located at an intake port 109 between the ear enclosure volume 104 and the control volume 106, and an exhaust valve 110 located at an exhaust port 111 between the control volume 106 and the ambient environment 112 outside the ear cup 102. Ports, such as intake port 109 and exhaust port 111 comprise air ports that enable a fluidic coupling, or a fluid air connection that allows air to flow between different environments. For example, an ear enclosure volume 104 can be fluidically coupled with a control volume 106 through an intake port 109, and a control volume 106 can be fluidically coupled with the ambient environment 112 through an exhaust port 111.

As discussed, described, illustrated, referred to, or otherwise used herein, check valves such as intake valve 108 and exhaust valve 110, are intended to encompass any of a wide variety of valves, controllers, regulators, stopcocks, spigots, taps, or other devices that are capable of functioning as non-return-type valve devices that can enable air flow in a forward or first direction and prevent air flow in a backward or second direction. Some examples of different types of valves that may be appropriate for use as an intake valve 108 and/or an exhaust valve 110 include diaphragm valves, umbrella valves, ball valves, swing valves, lift-check valves, in-line check valves, and combinations thereof. In some examples, such valves can employ alternate opening mechanisms such as sliding mechanisms that slide across an aperture to expose a port or opening (e.g., ports 109, 111) in the ear cup 102, different intersecting port shapes formed in the ear cup 102 that provide static openings, and so on. Thus, while the term "check valve" or "valve" is used throughout this description, other similarly functional devices of all types are possible and are contemplated herein for use as or within any examples.

Figure 2:
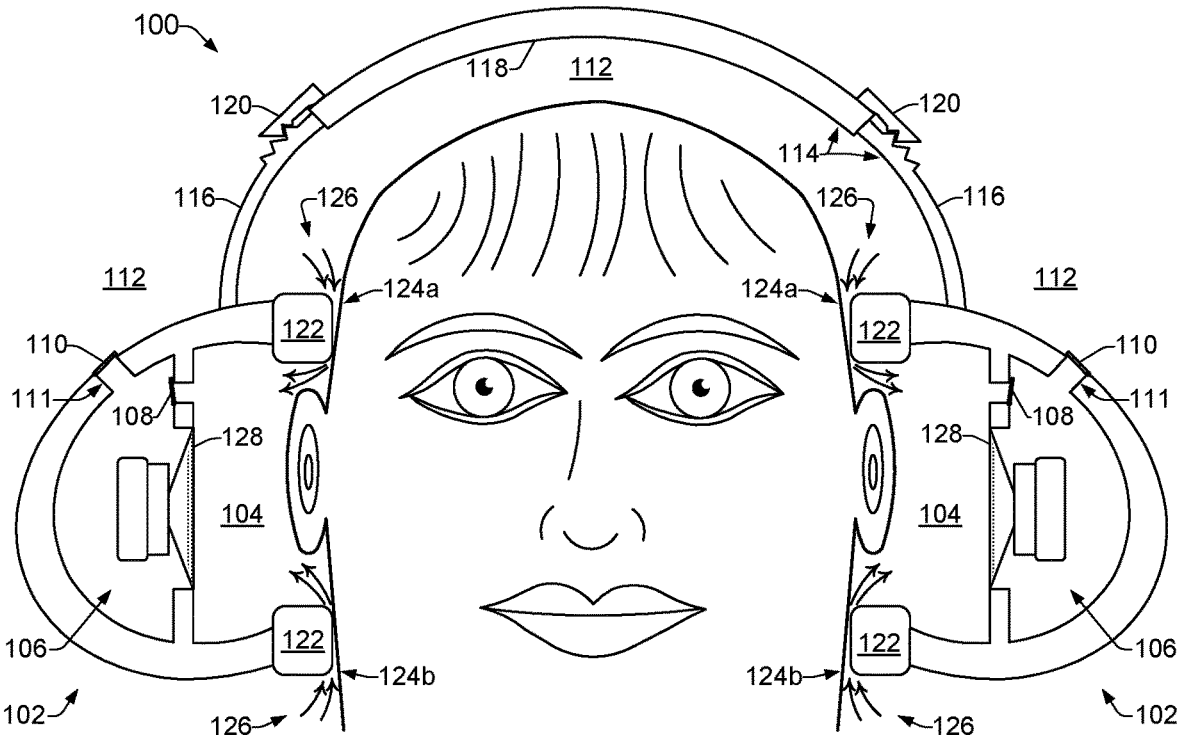
FIG. 2 shows the example self-cooling headset with additional details to facilitate further discussion of an example construction and operation of the headset; and, FIGS. 3*a* and 3*b* show an ear cup of a self-cooling headset at different stages of operation.

FIG. 2 shows the example self-cooling headset 100 with additional details, including the outline of a user's head and ears, to facilitate further discussion of an example construction and operation of the headset 100. Referring to FIGS. 1 and 2, the ear cups 102 to be worn over a user's ears can be connected by a head piece 114. The head piece 114 can be adjustable to accommodate users of varying ages and head sizes. The head piece 114 can be adjustable to firmly secure each ear cup 102 against a user's head in a manner that helps to isolate the ear enclosure volume 104 from the ambient environment 112 outside of the ear cup 102. Greater isolation of the ear enclosure volume 104 from the ambient environment 112 can provide an improved audio experience for the user. The head piece 114 can be adjustable, for example, with extendable and retractable end pieces 116 that telescope from a center piece 118 and latch into different positions with a latching mechanism 120. Ear cushions 122 can be attached to each ear cup 102 to help provide comfort for the user and to improve isolation of the ear enclosure volume 104 from the ambient environment 112. The cushions 122 can be formed, for example, from soft rubber, foam, foam-rubber, and so on.

As shown in FIG. 1, each ear cup 102 may include an ambient air port 124 between the ear enclosure volume 104 and the ambient environment 112. In some examples, an ambient valve (not shown) may also be located at the ambient air port 124. Although the ambient air port 124 is shown in FIG. 1 toward the lower part of the ear enclosure volume 104, the location of an ambient air port 124 around the ear enclosure volume 104 can be anywhere around the ear enclosure volume 104 that tends to facilitate the flow of cooler ambient air into the ear enclosure volume 104 from the ambient environment 112. Fresh air flow 126 into the ear enclosure volume 104 from the ambient environment 112 can be illustrated in FIG. 1, for example, by air flow arrows 126. The flow of fresh ambient air 126 into the ear enclosure volume 104 is discussed in greater detail herein below.

As shown in FIG. 2, the ear cups 102 may not include a designated ambient air port 124. However, because the interface between the cushions 122 and the user's skin may not form an airtight seal, fresh air flow 126 into the ear enclosure volume 104 from the surrounding ambient environment 112 can occur. Imperfections in the interface between the ear cushions 122 a user's head, face, and/or skin, can effectively provide leakage points around the cushions 122 that enable air flow 126 to occur between the ear enclosure volume 104 and the ambient environment 112. The imperfections in the cushion-skin interface can be the result, for example, of contours on the surface of the cushion 122, and the manner in which those contours interface with the particular shape of the user's head and face. Thus, an ambient air port 124 can comprise a natural ambient air port 124 that includes the sum of the various leakages that may exist between the interface of the cushions 122 and the user's head, face, and/or skin. For example, as shown in FIG. 2, an air leakage 124*a* can occur toward the top side of an ear cup cushion 122 where the cushion interfaces with the temple area of a user's head, while another air leakage 124*b* can occur toward the bottom side of an ear cup cushion 122 where the cushion interfaces with the cheek area of the user's head. Other leakages can occur in areas all around the circumference of the cushion 122 as it interfaces with different areas of a user's head. The sum of such leakages can comprise a natural ambient air port.

Figure 3A:
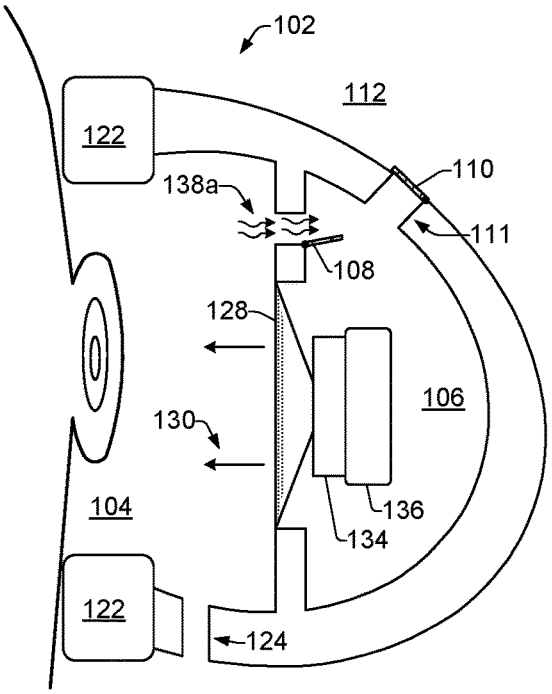
Figure 3B:
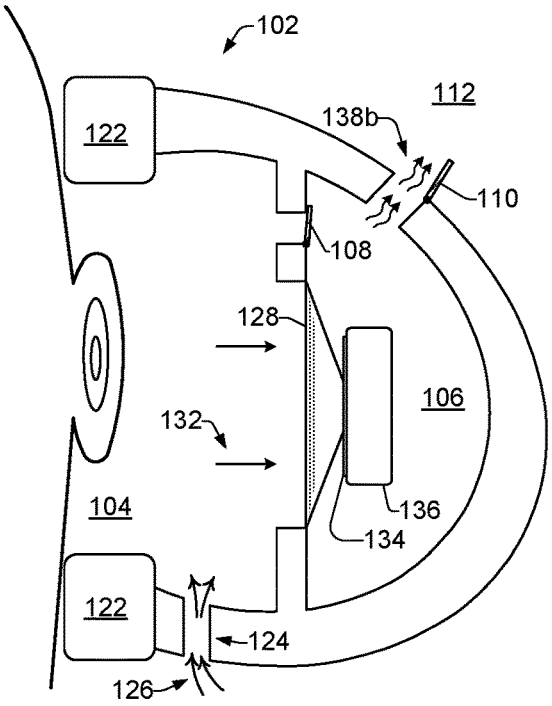

Air flow within and through an ear cup 102 of a self-cooling headset 100 can be created by translation of a speaker transducer 128 in forward and reverse directions. A speaker transducer 128 can also be referred to as a speaker diaphragm and a speaker cone. FIGS. 3*a* and 3*b* show an ear cup 102 of a self-cooling headset 100 at different stages of operation in which the speaker transducer 128 moves in forward and reverse directions. During operation, the speaker transducer 128 can translate in a forward direction 130 (i.e., toward, or into the ear enclosure volume 104, and away from, or out of the control volume 106) as shown in FIG. 3*a*, and in a reverse direction 132 (i.e., away from, or out of the ear enclosure volume 104, and toward, or into the control volume 106) as shown in FIG. 3*b*. Components that generate the forward 130 and reverse 132 motions of the speaker transducer 128 include a voice coil wrapped cylinder 134 and a stationary magnet 136. During operation, incoming electrical signals traveling through the coil 134 turn the coil into an electromagnet that attracts and repels the stationary magnet 136. Attraction and repulsion of the magnet 136 by the coil 134 causes movement of the coil 134 and speaker transducer 128 in a forward and reverse direction according to the incoming electrical signals.

In different examples, electrical signals for driving the speaker transducer 128 can be received by a wired or wireless connection to the headset 100. In some examples, incoming electrical signals comprise audio signals that drive the speaker transducer 128 to create audible sound within the ear enclosure volume 104. In some examples, incoming electrical signals can drive the speaker transducer 128 in forward and reverse directions without creating audible sound within the ear enclosure volume 104. Thus, there is no intent to limit the nature of incoming electrical signals that can drive the speaker transducer 128. Whether audible sound is created within the ear enclosure volume 104 or not, incoming electrical signals can drive the speaker transducer 128 to translate in forward 130 and reverse 132 directions.

Referring generally still to FIGS. 3*a* and 3*b*, translation of a speaker transducer 128 generates air flow within and through an ear cup 102 of a self-cooling headset 100 by creating alternating positive and negative pressures within the control volume 106. In FIGS. 3*a* and 3*b*, the air 138 that moves into and out of the control volume 106 is illustrated as pairs of short wavy arrows 138*a* and 138*b*. The air moving into the control volume 106 is illustrated by wavy arrows 138*a* shown in FIG. 3*a*, while the air moving out of the control volume is illustrated by wavy arrows 138*b* shown in FIG. 3*b*. As shown in FIG. 3*a*, translation of the speaker transducer 128 in the forward direction 130 creates a negative pressure within the control volume 106 that opens up the intake valve 108 and draws air 138*a* from the ear enclosure volume 104 into the control volume 106. The negative pressure created within the control volume 106 opens up the intake valve 108 while at the same time pulling closed the exhaust valve 110. The air 138*a* drawn into the control volume 106 from the ear enclosure volume 104 is generally warm air that has been heated by close contact with the user's skin. This warm air 138*a* being removed from the ear enclosure volume 104 can be replaced by cooler fresh air 126 entering the ear enclosure volume 104 through the ambient air port 124, as discussed below with reference to FIG. 3*b*.

As shown in FIG. 3*b*, translation of the speaker transducer 128 in the reverse direction 132 creates a positive pressure within the control volume 106 that opens up the exhaust valve 110 and pushes air 138*b* out of the control volume 106 and into the surrounding ambient environment 112. The positive pressure created within the control volume 106 opens up the exhaust valve 110 while at the same time pulling closed the intake valve 108. In addition to creating a positive pressure within the control volume 106, translation of the speaker transducer 128 in the reverse direction 132 also draws cooler fresh air 126 from the ambient environment into the ear enclosure volume 104 through the ambient air port 124. Note that during use of the headset 100, the ear enclosure volume 104 is mostly closed off by a user's head and ear, as shown in FIG. 2. As noted above with reference to FIG. 2, the ambient air port 124 can comprise a natural ambient air port 124 that includes the sum of various leakages (e.g., 124*a*, 124*b*) that may exist between the interface of the cushions 122 and the user's head, face, and/or skin.

Accordingly, as just discussed with reference to FIGS. 3*a* and 3*b*, the translation of the speaker transducer 128 in forward and reverse directions alternately creates negative and positive pressures within the control volume 106 that control the movement of air 138*a* into the control volume 106 and air 138*b* out of the control volume 106, as well as the movement of fresh air 126 into the ear enclosure volume 104. This circulation or exchange of air in the ear enclosure volume 104 reduces the temperature within the ear enclosure volume 104.

What is claimed is:

1. A self-cooling headset comprising:

an ear cup to form an ear enclosure volume and a control volume;

a one-way intake check valve to open in a single direction and admit air from the ear enclosure volume into the control volume when a negative pressure is generated within the control volume; and, a one-way exhaust check valve to open in a single direction and release air from the control volume into the ambient environment when a positive pressure is generated within the control volume.

2. A self-cooling headset as in claim 1, further comprising:

a speaker transducer to translate in a forward direction to generate a negative pressure within the control volume to open the intake check valve, and to translate in a reverse direction to generate a positive pressure within the control volume to open the exhaust check valve.

3. A self-cooling headset as in claim 2, wherein translation of the speaker transducer in the forward direction comprises movement of the speaker transducer in a direction out of the control volume and into the ear enclosure volume, and translation of the speaker transducer in the reverse direction comprises movement of the speaker transducer in a direction into the control volume and out of the ear enclosure volume.

4. A self-cooling headset as in claim 1, wherein the speaker transducer is to translate in a forward and reverse direction to generate audible sound within the ear enclosure volume.

5. A self-cooling headset as in claim 1, further comprising:

an ambient air port to enable fresh air from the ambient environment to enter the ear enclosure volume and replace air drawn into the control volume from the ear enclosure volume.

6. A self-cooling headset as in claim 5, further comprising:

an ear cushion to be pressed against a user's head to cause a cushion-skin interface between the ear cup and the user's head;

wherein the ambient air port comprises a sum of leakages around the ear cushion at the cushion-skin interface.

7. A self-cooling headset as in claim 1, further comprising:

an intake port between the ear enclosure volume and the control volume through which air from the ear enclosure volume can pass into the control volume; and, an exhaust port between the control volume and the ambient environment through which air from the control volume can pass into the ambient environment.

8. A self-cooling headset comprising:

an intake check valve between an ear enclosure volume and a control volume of a headset ear cup to enable air flow from the ear enclosure volume to the control volume and prevent air flow from the control volume to the ear enclosure volume;

can enable air flow in a forward or first direction and prevent air flow in a backward or second direction an exhaust check valve between the control volume and an ambient environment outside the ear cup to enable air flow from the control volume to the ambient environment and prevent air flow from the ambient environment to the control volume; and, a speaker transducer to translate in a forward direction toward the ear enclosure volume to generate a negative pressure in the control volume for opening the intake check valve and drawing air into the control volume from the ear enclosure volume, and to translate in a reverse direction toward the control volume to generate a positive pressure in the control volume for opening the exhaust check valve and pushing air from the control volume into the ambient environment.

9. A self-cooling headset as in claim 8, further comprising:

an ambient air port between the ear enclosure volume and the ambient environment to enable fresh air from the ambient environment to replace air drawn into the control volume from the ear enclosure volume.

10. A self-cooling headset as in claim 8, further comprising:

an ear cushion to provide an interface between the headset ear cup and a user's head; and, a sum of leakages at the interface to provide an ambient air port to enable fresh air from the ambient environment to replace air drawn into the control volume from the ear enclosure volume.

11. A self-cooling headset comprising:

a speaker transducer;

an ear enclosure chamber and a control chamber fluidically coupled together by an intake port, the control chamber further fluidically coupled to an ambient environment by an exhaust port;

a one-way intake check valve at the intake port to open by operation of the speaker transducer and allow air to pass from the ear enclosure chamber into the control chamber; and, a one-way exhaust check valve at the exhaust port to open by operation of the speaker transducer and allow air to pass from the control volume to the ambient environment.

12. A self-cooling headset as in claim 11, wherein:

the control chamber comprises a control chamber under negative pressure when the speaker transducer translates in a forward direction, the negative pressure to cause the intake check valve to open and the exhaust check valve to close; and, the control chamber comprises a control chamber under positive pressure when the speaker transducer translates in a reverse direction, the positive pressure to cause the intake check valve to close and the exhaust check valve to open.

13. A self-cooling headset as in claim 11, further comprising:

an ambient air port to allow ambient air from the ambient environment to pass into the ear enclosure chamber and replace air that has passed from the ear enclosure chamber into the control chamber.

14. A self-cooling headset as in claim 13, wherein the ambient air port comprises a sum of air leaks in an interface between an ear cushion and a user's head.

15. A self-cooling headset as in claim 11, further comprising:

two ear cups coupled together by a head piece;

wherein each ear cup comprises an ear enclosure chamber and a control chamber positioned adjacent to one another in the ear cup.

* * * * *